United States Patent [19]

Childers et al.

[11] Patent Number: 4,620,559

[45] Date of Patent: Nov. 4, 1986

[54] HIGH-SPEED COIN-SORTING AND COUNTING APPARATUS

[75] Inventors: Roger K. Childers; James R. Burt, both of Multnomah County, Oreg.

[73] Assignee: Childers Corporation, Wilsonville, Oreg.

[21] Appl. No.: 658,534

[22] Filed: Oct. 9, 1984

[51] Int. Cl.[4] ..... G07D 3/16

[52] U.S. Cl. ..... 133/3 A; 194/346; 133/8 R

[58] Field of Search ..... 133/3 R, 3 A, 3 B, 3 E, 133/3 G, 3 H, 8 R, 8 A; 194/1 C, 1 D, 1 K, 346; 377/7

[56] References Cited

U.S. PATENT DOCUMENTS

| | | | |
|---|---|---|---|
| 2,348,936 | 5/1944 | Sprenger | 133/3 R |
| 2,977,961 | 4/1961 | Buchholz et al. | 133/3 R |
| 3,795,252 | 3/1974 | Black | 133/3 A |
| 3,998,237 | 12/1976 | Kressin et al. | 133/3 A |
| 4,086,928 | 5/1978 | Ristvedt | 133/3 A |
| 4,105,105 | 8/1978 | Braum | 194/100 A |
| 4,111,216 | 9/1978 | Brisebarre | 133/3 A |
| 4,503,961 | 3/1985 | Chittleborough | 194/1 C |
| 4,506,685 | 3/1985 | Childers | 133/3 A |

FOREIGN PATENT DOCUMENTS

| | | | |
|---|---|---|---|
| 2397684 | 3/1979 | France | 133/3 A |

*Primary Examiner*—F. J. Bartuska
*Attorney, Agent, or Firm*—Seed and Berry

[57] ABSTRACT

A coin-sorting and counting machine having a stationary base and a cylindrical frame wall rotatably mounted on the base for selective rotation relative thereto. A rotatable disc with a queueing head spaced thereabove forms the coins into a queue at the perimeter of the disc whereat they are sorted by denomination, using coin depressing wheels. Counters count the coins according to denomination. The machine further includes a bag-holding receptacle for each denomination of coin being sorted to collect preselected numbers of the coins according to denomination, and holding for collecting and temporarily holding coins in excess of the preselected numbers according to denomination. The receptacles are held on a carrier plate and arranged concentrically about a pedestal supporting the frame wall. The holding tanks each have a manually operable slide gate to selectively transfer the collected excess coins therein to the coin bags. The machine has coin receivers which selectively divert the coins to the receptacles or, in response to the predetermined numbers of coins being counted, to the holding tanks. The discs, queueing head, sorting wheels, counters, bag receptacles, and holding tanks are mounted for rotation with the frame, and may be rotated to selectively bring a bag receptacle to the operator for its removal while the machine is sorting and counting coins.

45 Claims, 10 Drawing Figures

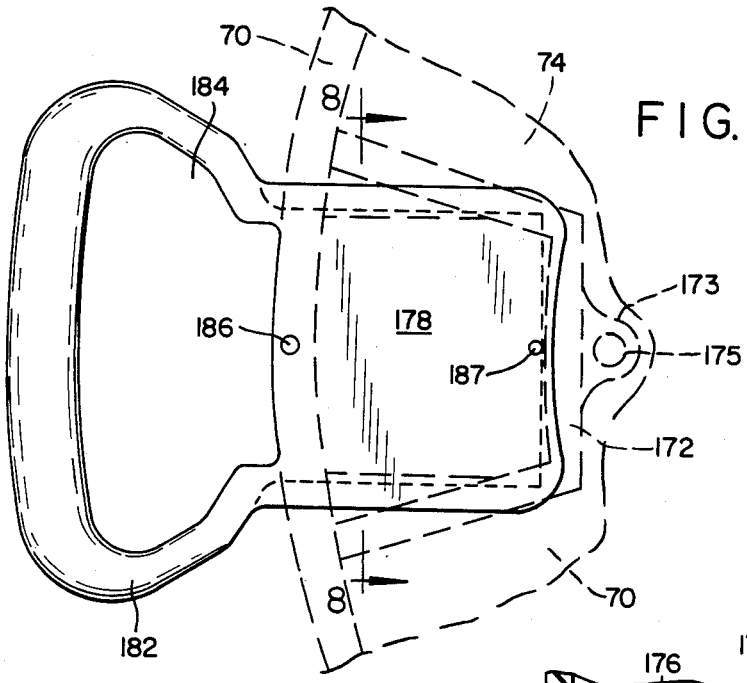
FIG. 7
FIG. 8
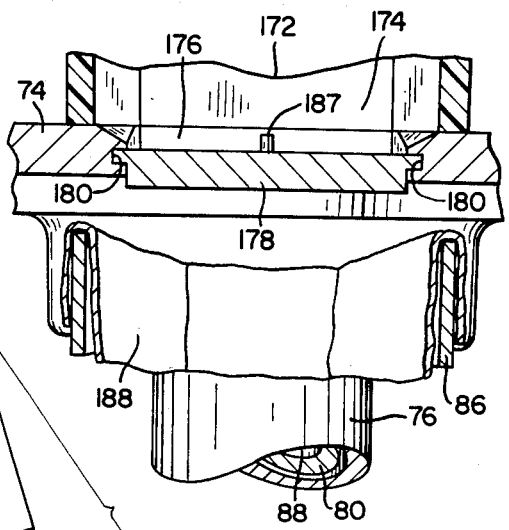
FIG. 9
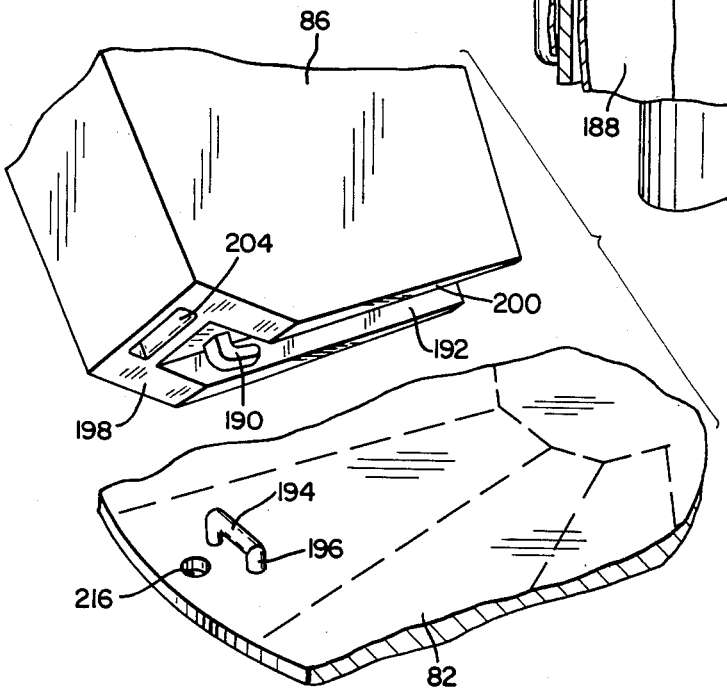

HIGH-SPEED COIN-SORTING AND COUNTING APPARATUS

DESCRIPTION

1. Technical Field

This invention relates to coin-sorting and counting apparatus.

2. Background Art

The large and increasing volume of token and coin-operated machines makes the rapid and accurate sorting and counting of tokens and coins an economic necessity. Vending machine, metropolitan area transit systems, pay telephones, and other token and coin-operated devices have expanded the use of tokens and coins and the requirements for economical sorting and counting of coins beyond all expectations.

Several machines have been designed for the counting of coins, such as the machines disclosed in U.S. Pat. Nos. 2,906,276 (to Blanchette et al.); 2,977,961 (to Buchholtz et al.); 3,795,252 (to Black); 3,998,237 (to Kressin et al.); 4,086,928 (to Ristvedt et al.); 4,098,280 (to Ristvedt et al.); 4,234,003 (to Ristvedt et al.); and 4,111,216 (to Brisebarre). Each has coin-sorting by centrifugal force according to denomination, counting of the individual denominations by some type of sensing means, and storing and display of the information about the counts during the process. Each also provides means for collecting the sorted coins during the counting operation, and removing and storing the collected coins after the counting operation is complete. Typically, the sorted and counted coins are deposited in coin bags.

In such machines, the centrifugal force is imparted to the coins by the rotation of a disc onto which coins are delivered in bulk with random orientation, usually through a central hopper. In some of the machines, the coins are then guided by a head positioned immediately over the disc to deliver them in a single file, single layer queue to a position adjacent to a peripheral retaining rim of the disc. At the peripheral rim, the coins are selectively engaged according to denomination by one of a plurality of engagement means such as wheels, blades, cams or the like positioned around the peripheral rim. The engagement means depresses or lifts the coins to free them from the peripheral rim of the disc and allows the centrifugal force to hurl them through the air to one of a plurality of correspondingly positioned catching devices. The coins are then diverted to the appropriate coin bags. The sorting is typically accomplished by the engagement means based upon the differences in diameter of the various denominations of coins being processed. The count is usually made by photoelectric means which sense the number of coins entering each catching device. In other of the machines the sorting is accomplished without use of a peripheral rim and engagement means, but rather through capturing and selective release of the coins according to denomination.

Since the machines such as those mentioned above operate on the centrifugal force imparted to the coins by the rotation of the disc to hurl them into a catching device, it is necessary to keep the disc rotating at full speed during the entire sorting and counting of all coins of a batch that have been dumped into the hopper. Should a preselected number of coins of a particular denomination be counted by the machine and placed in a coin bag, the disc must continue rotating and all additional coins of that denomination must be diverted into a second coin bag. In the past, this has been accomplished by a switching unit which, upon a signal that the preselected count has been achieved in the first coin bag, switches the remainder of the coins of that denomination into a second coin bag. Such arrangements are shown in U.S. Pat. Nos. 3,795,252 and 4,111,216. In part, the requirement for two bags for each denomination of coin being sorted and counted accounts for the large size of the machines, and the substantial amount of floor space they require.

With machines of the type described above, it is important to know if any coins have fallen off of the rotating disc or have been hurled off the disc and missed the target catching device. It is also important to have some means for easy retrieval of these coins without disrupting the operation of the machine and without extensively dismantling of the machine when the sorting and counting of the batch of coins is complete.

In addition, the machine should have means for purposely ejecting any coins or foreign objects which reach the peripheral rim of the disc but are not hurled from the disc by one of the engagement means. This is to prevent these coins and foreign objects from passing back between the disc and the head. As with coins which have fallen off the disc or missed their target, the unsorted coins and foreign objects which are ejected from the disc should be made known to the operator of the machine and collected in a manner which does not disrupt operation of the machine or require its dismantlement.

It will be appreciated that there has been a significant need for a compact high-speed coin-sorting and counting apparatus designed to overcome the disadvantages and provide the advantages described. The present invention fulfills this need and further provides other related advantages.

DISCLOSURE OF INVENTION

The present invention resides in a coin-sorting and counting apparatus having means for sorting and counting a batch of coins by denomination; first coin-collecting means for collecting preselected numbers of the sorted coins according to denomination, and for selectively removing the collected coins from the apparatus; second coin-collecting means for collecting the sorted coins of the batch in excess of the preselected numbers according to denomination, and for selectively transferring the collected excess coins to the first collecting means according to denomination upon removal from the apparatus of the preselected number of coins collected by the first coin storage means; and coin receiver means for receiving the sorted and counted coins according to denomination, and for selectively diverting the coins to the first or second coins selecting means according to denomination. The coin receiver means first diverts the coins to the first collecting means, and in response to the preselected numbers of coins being counted by the sorting and counting means, diverts the coins in excess of the preselected numbers to the second coin-collecting means. The sorting and counting means, the second coin-collecting means, and the coin receiver means are supported by a frame rotatably mounted on a stationary base. The first coin-collecting means is mounted for rotation with the frame.

The first coin-collecting means includes a coin receptacle for each denomination of coin being sorted and the second coin-collecting means includes a holding tank for each denomination of coin being sorted. The coin receiver means includes a coi switching unit for each denomination of coin being sorted. Each of the holding tanks has a coin receiving port positioned to receive the excess sorted coins from the coin receiver means and a coin discharge port with a selectively operable closure for selective discharge of the excess sorted coins collected within the holding tank directly into the coin receptacle for the corresponding denomination of coin. The closures are manually operable slide gates, each having a handle for operatively grasping by the operator. The gate is outwardly slidable to open the discharge port of the holding tank for the transfer of the excess coins collected therein. The handle is positioned between the coin switching unit and the coin receptacle for the coin denomination in the flow of coins of that denomination therebetween, and has an aperture to pass the flow of coins when the handle is in a closed position.

The first coin-collecting means includes open ended bag holding containers carried on a carrier plate mounted for rotation with the frame. Each of the containers for a particular denomination of coin is positioned below the coin receiver and the holding tank for the corresponding denomination of coin to receiver coins therefrom. The containers are pivotally attached to the carrier plate by a detachable hinge for selectively tilting the container forward or removing the container from the carrier plate. The containers have a generally wedge-shaped cross section and are positioned below and generally concentric with the frame. The containers each have an elongated guide channel sized and positioned to slidably receive a hinged portion of the hinge which is fixedly attached to the carrier plate. The channel extends in a radial direction when the container is in position on the carrier plate and the hinge portion fixed to the carrier plate limits lateral movement of the container as the container is moved on the plate with the hinge detached. The containers have a beveled portion for supportably engaging the carrier plate when tilted, and a flat portion for supportably engaging the carrier plate or the ground when resting upright thereon.

In one embodiment of the invention, the counting and sorting means includes a rotatable disc and queueing means for positioning coins in a queue at the perimeter of the disc. Sorting means are provided to release the coins from the disc at selected locations along its circumference according to denomination, and hurl the coins by centrifugal force. The apparatus further includes a catching plate fixedly attached to the disc for rotation therewith. The catching plate is positioned below the disc and extends outwardly beyond the disc to catch coins and foreign objects falling off or ejected from the disc. The caught coins and foreign objects are moved by centrifugal force to a perimeter portion of the plate whereat they are retained by a cylindrical sidewall of the frame. The sidewall has an aperture through which the caught coins and foreign objects can pass under the influence of the centrifugal force and into a receptacle positioned outward of the sidewall. Detecting means are provided for detecting the presence of the caught coins or foreign objects.

A plurality of selectively operable coin dump trays are positioned above the disc for selective dumping of batches of coins thereon. Lock means is provided for selectively locking the frame against rotation when accessing the bag containers.

Other features and advantages of the invention will become apparent from the following detailed description, taken in conjunction with the accompanying drawings.

BRIEF DESCRIPTION OF THE DRAWINGS

FIG. 7 is an enlarged, fragmentary, sectional view taken substantially along the line 7—7 of FIG. 3, showing the manually operated dump gate of the present invention.

FIG. 8 is a fragmentary, sectional view taken substantially along the line 8—8 of FIG. 7, showing a bag holder positioned below the dump gate.

FIG. 9 is an enlarged, fragmentary, isometric view of the bottom of a bag holder removed from its mounting plate.

BEST MODE FOR CARRYING OUT THE INVENTION

Figure 1:
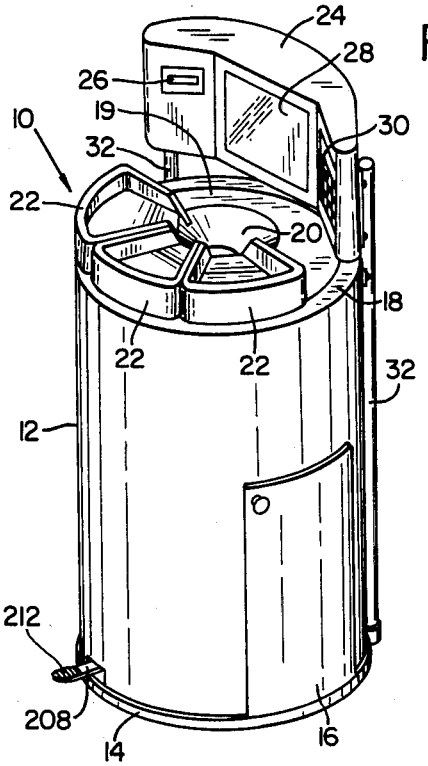
FIG. 1 is an isometric view of a coin-sorting and counting apparatus embodying the present invention.
Figure 2:
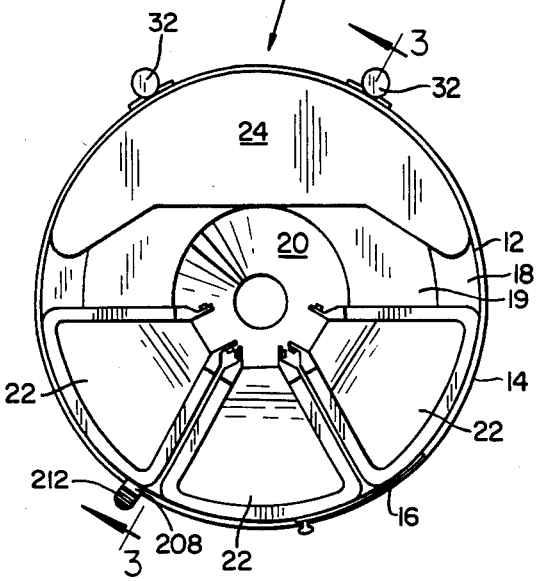
FIG. 2 is an enlarged, top plan view of the coin-sorting and counting apparatus shown in FIG. 1.
Figure 3:
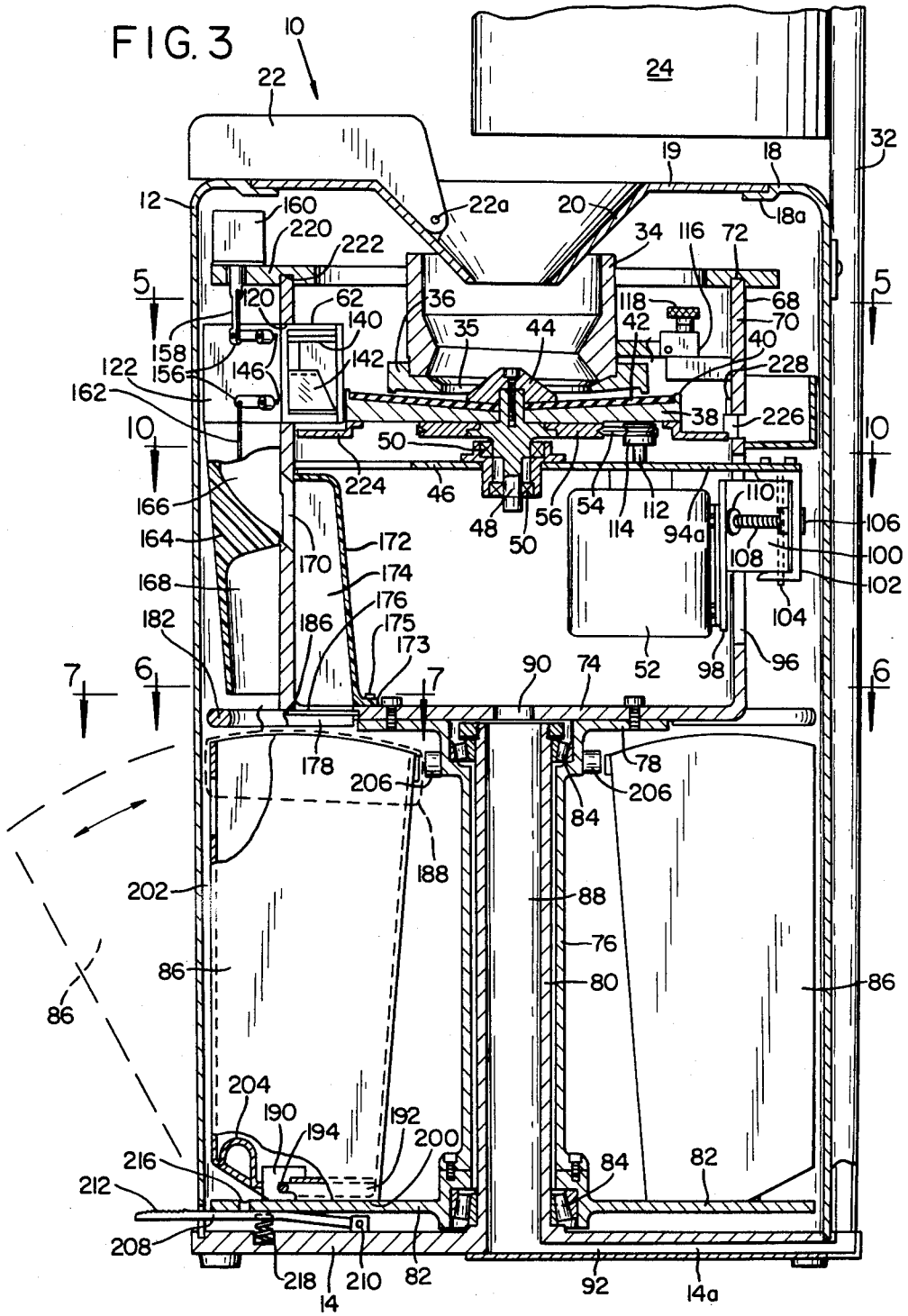
FIG. 3 is an enlarged, partially fragmentary, sectional view taken substantially along the line 3—3 of FIG. 2.

As shown in the drawings for purposes of illustration, the present invention is embodied in a high-speed coin-sorting and counting apparatus, indicated generally by reference numeral 10. As best shown in FIGS. 1 and 3, the coin-sorting and counting apparatus 10 includes an outer cylindrical housing 12 mounted on a stationary circular base 14 with a hinged door 16 for access to the interior of the case. The case 12 has an annular upper end wall 18 with an inner lip **18*a* to supportably hold a removable top assembly lid 19 having a central funnel 20 extending therethrough. Three generally wedge-shaped coin loading trays 22 are each hingedly attached to the funnel 20 by their open end for dumping of a batch of coins contained therein into the funnel. The coin-sorting and counting apparatus 10 further includes a control panel 24 with an alphanumeric printer 26, a video display terminal 28, and a panel 30 containing illuminated signal lights, audible indicators, switches and a keyboard. The display panel 24 is mounted above the case 12 on a pair of poles 32 which are fixedly attached to the case 12 and to the stationary base 14. At least one of the poles 32 is hollow and serves as a conduit for electrical wires extending between the control panel 24 and the interior of the case 12 via a tunnel 14*a* in the base 14**.

An undifferentiated mix of coins with random orientation comprising a batch of coins such as received from a particular vending machine, pay telephone, toll collecting booth or other source of coins can be placed in one of the loading trays 22, with two other batches of coins being placed in each of the other two loading trays and held in ready for subsequent processing. The loading tray 22 containing the batch of coins to be processed may be tilted to dump the coins into the funnel 20 by lifting the loading tray upward and pivoting the tray about a hinge 22*a* connected to the wall of the funnel.

Positioned below the funnel 20 is a hopper 34 to receive the batch of coins dumped from the loading tray 22 (see FIGS. 3 and 5). The hopper 34 is rigidly attached to a queueing head 36 and extends upwardly therefrom. The queueing head 36 is mounted is spaced arrangement above a rotatable circular disc 38. The hopper 34 has a corkscrew interior shape and coins dumped into the hopper are channeled into a central opening 35 in the queueing head 36 and deposited on the rotating disc 38. Centrifugal force is imparted to the coins by rotation of the disc 38.

Figure 10:
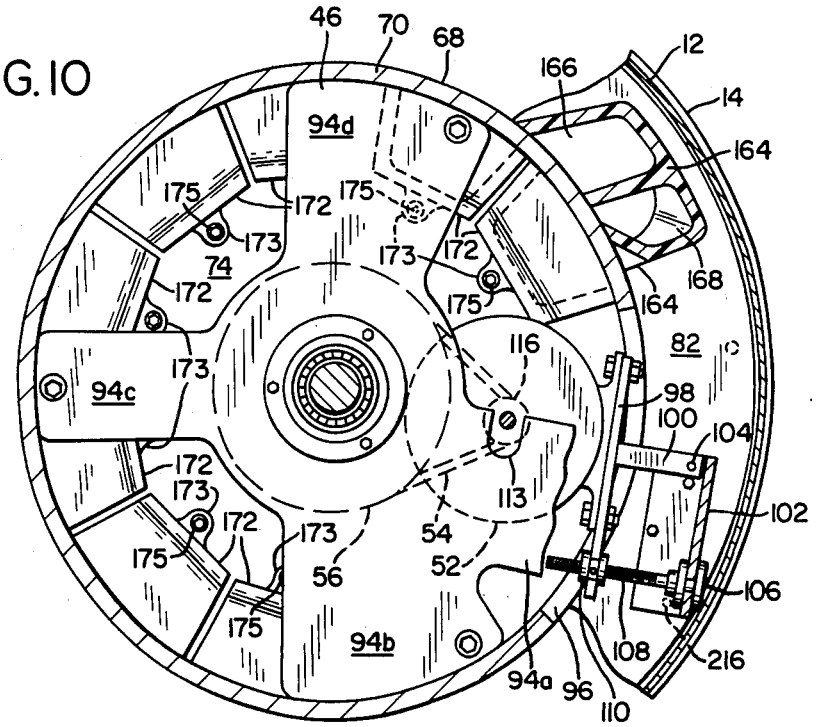
FIG. 10 is a reduced, sectional view taken substantially along the line 10—10 of FIG. 3.

The queueing head 36 is positioned above an upper surface of the disc 38 by a preselected amount, with a lower surface or face of the head facing toward the upper surface of the rotating disc. A resilient frictional pad 42 covers the disc 38 and defines the upper surface of the disc. The lower surface of the head 36 is a low friction surface, preferably made of a durable metal. A conical member 44 is fixedly attached to the disc 38, at its center below the central opening 35, to prevent coins from remaining in the center of the disc by avoiding the centrifugal force caused by rotation of the disc. The centrifugal force is necessary to move the coins from the central opening 35 to a peripheral rim 40 of the disc 38 for sorting by denomination. The disc 38 is rotatably mounted to a plate 46 by a shaft 48 supported by a pair of frictionless roller bearings 50. As shown in FIGS. 3 and 10, a motor 52 drives the disc 38 through a belt 54. The belt 54 rides on a pulley 56 formed as an integral part of the disc 38, and rotates the disc.

As the coins come through the central opening 35 of the head 36, they enter a loading area and encounter the centrifugal force generated by the rotating upper surface of the disc. The centrifugal force is imparted to the coins by their contact with the rotating resilient frictional pad 42. As viewed from above in FIG. 5, the disc 38 rotates in the clockwise direction shown by the arrow 58. Consequently, the coins tend to move in a spiral direction away from the loading area and into the space between the lower surface of the head and the upper surface of the disc. While the coins travel between the stationary head 36 and the rotating disc 38 under the urging of the centrifugal force, they are guided and separated to place them in a nonstacked, single-file queue by the time they reach the peripheral rim 40, whereat coin-engaging wheels 60 sort the coins one at a time according to denomination, based on the diameter of the coins, as will be described in more detail below.

Guides (not shown) are attached to and project downward from the lower surface of the head 36 by various predetermined amounts toward the upper surface of the disc 38. The guides are shaped and arranged on the lower surface of the head in such a way as to channel the coins into the queue to be sorted. Guides of the above-described general type are shown and described in several of the previously mentioned patents. The coins pass from under the head 36 by the influence of the rotating disc 38, and thereafter are free of any control by the head. The disc 38 then carries the coins in the queue which is positioned adjacent to the peripheral rim of the disc to the coin-engaging wheels 60 for sorting by denomination.

The coin-engaging wheels 60 comprise a plurality of coin-depressing wheels, rotatably mounted to the head 36 at spaced intervals along the outer perimeter of the head. In a conventional manner, the coin-engaging wheels 60 extend from the head by various distances corresponding to the diameter of the coin to be depressed, with the largest diameter coin being sorted first, then the next largest second, and so on. It should be understood that for purposes of the present description, the term "coins" is used for convenience to describe both money and tokens. It should also be understood that the coin-sorting and counting apparatus 10 of the present invention is not limited to use with coin-depressing sorting wheels 60, and may be used in machines utilizing other means to sort the coins.

The coin-engaging the wheel 60 depresses the radially inner edge of a coin into the resilient frictional pad 42, causing its outer edge to raise the coins to be hurled over the peripheral rim 40 of the disc 38 by the centrifugal force into a coin-catching device 62. The coins are counted by an electro-optical sensor 64 as they are traveling through the air. One catching device 62 is positioned across from each coin-engaging wheel 60. Should for some reason a coin or foreign object not be hurled from the disc 38, a last ejector wheel 66 is provided with a width sufficient to engage all diameter coins and foreign objects carried on the disc and cause them to be sufficiently pressed into the resilient frictional pad 42 and bounced upwardly therefrom by the resiliency of the pad that the centrifugal force will hurl them off the disc.

The coin-sorting and counting apparatus 10 has an inner frame 68 which is rotatably mounted to the stationary base 14 and provides the support structure for the disc 38, the head 36, the coin-catching devices 62 and the motor 52, as well as other components of the apparatus which will be described below. The frame 68 has a cylindrical sidewall 70 with an open upper end 72 and a circular lower end wall 74 formed integrally with the sidewall. A tubular outer support post 76 is rigidly attached to the underside of the end wall 74 of the frame 68 by a flange 78. The outer post 76 rotatably mounted on a tubular inner support post 80. The inner support post 80 is rigidly attached to the stationary base 14. A radially extending circular carrier plate 82 is rigidly attached to the lower end of the outer post 76 for carrying a plurality of coin-collecting receptacles 86, one for each denomination of coin being sorted and counted, as will be described in more detail below. The outer post 76 and the carrier plate 82 are rotatably mounted to th inner post 80 by a pair of frictionless roller bearings 84. The outer and inner posts 76 and 80 are centrally mounted with respect to the stationary base 14, the end wall 74 and the carrier plate 82 for concentric movement of the cylindrical frame sidewall 70 and the carrier plate relative to the circular, stationary base.

The inner post 80 has a central opening 88 communicating with an aperture 90 in the frame end wall 74 and for the passage of electrical wires therethrough, and the opening 88 connects with the base tunnel 14*a*.

As shown in FIG. 10, the plate 46 supporting the disc 38 is generally spoke-shaped with four spokes 94 a, b, c and d, and is rigidly attached to the interior of the frame sidewall 70. One of the spokes 94*a* extends laterally outward through an opening 96 in the frame sidewall 70 and provides support for an adjustable motor-carrying mount 98 positioned below the spoke. The mount 98 supports the motor 52 interior of the frame sidewall 70 and has a member 100 extending outwardly through the opening 96. The member 100 is pivotally attached to a "C" bracket by a pivot pin 104. The bracket 102 is rigidly attached by an upper end portion 105 to the spoke 94*a* at a point exterior of the frame sidewall 70. By rotation of the mount 98 about the pivot pin 104, the tension on the drive belt 54 can be selectively adjusted.

The belt adjustment is accomplished exteriorly of the frame sidewall 70 by a hand-operated, rotatable knob 106 rotatably attached to the bracket 102 and restrained against longitudinal movement. The knob 106 threadably receives a threaded shaft 108 which is also threadably received by a nut 110 rigidly attached to the mount 98. By turning of the knob 106, the nut 110 travels along the shaft 108 in a direction depending upon the direction of rotation of the knob and pivots the mount 98 about the pivot pin 104 to adjust the tension of the belt 54.

The motor 52 has a drive shaft 112 which extends upwardly through a slotted aperture 113 in the support plate 46, with a pulley 114 thereon positioned coplanar with the pulley 56 attached to the disc 38. The disc 38 is positioned at the center of the support plate 46 and is concentrically centered with the cylindrical frame sidewall 70.

Figure 5:
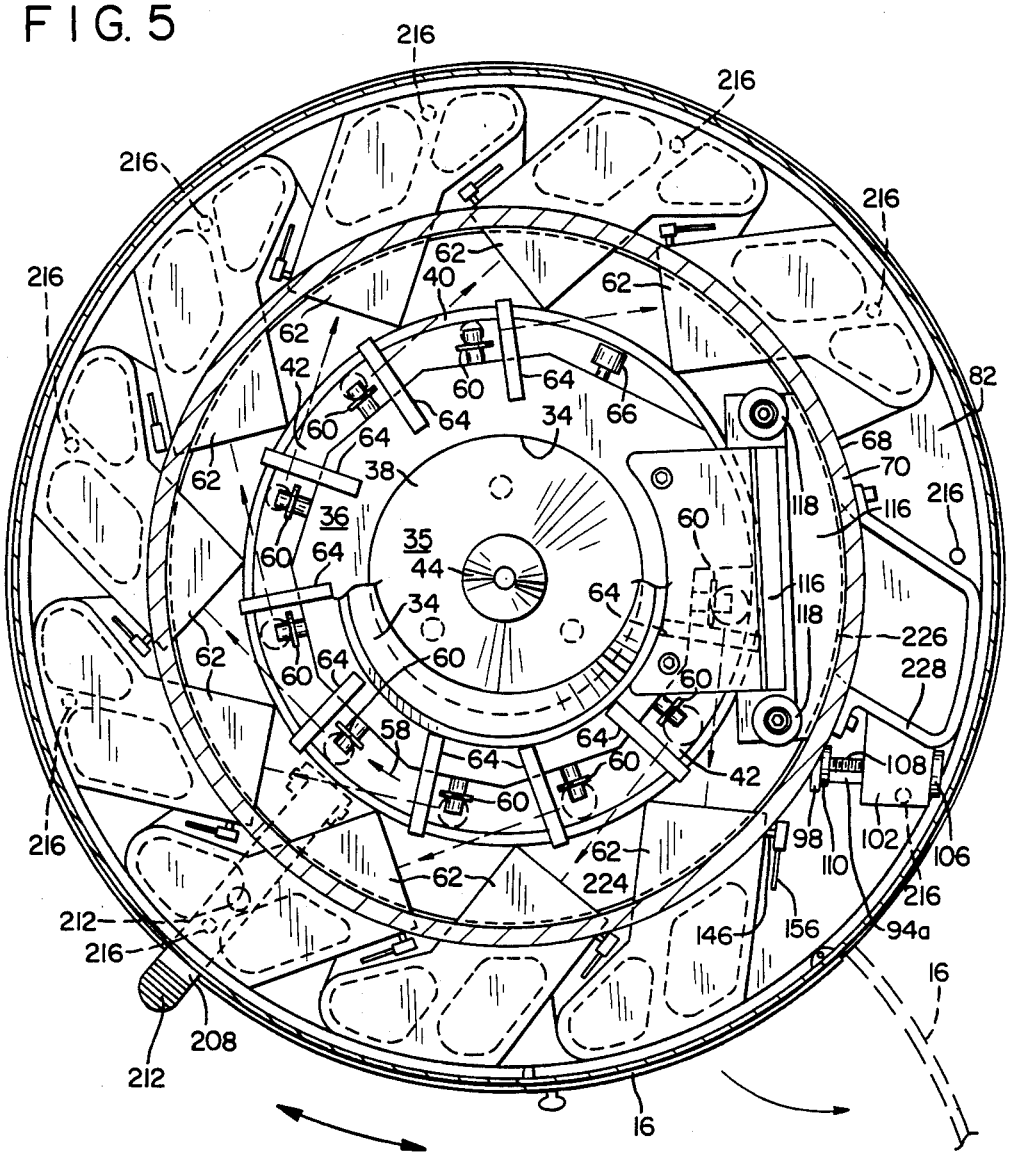
FIG. 5 is an enlarged, sectional view taken substantially along the line 5—5 of FIG. 3, showing the access door in phantom in an open position.
Figure 6:
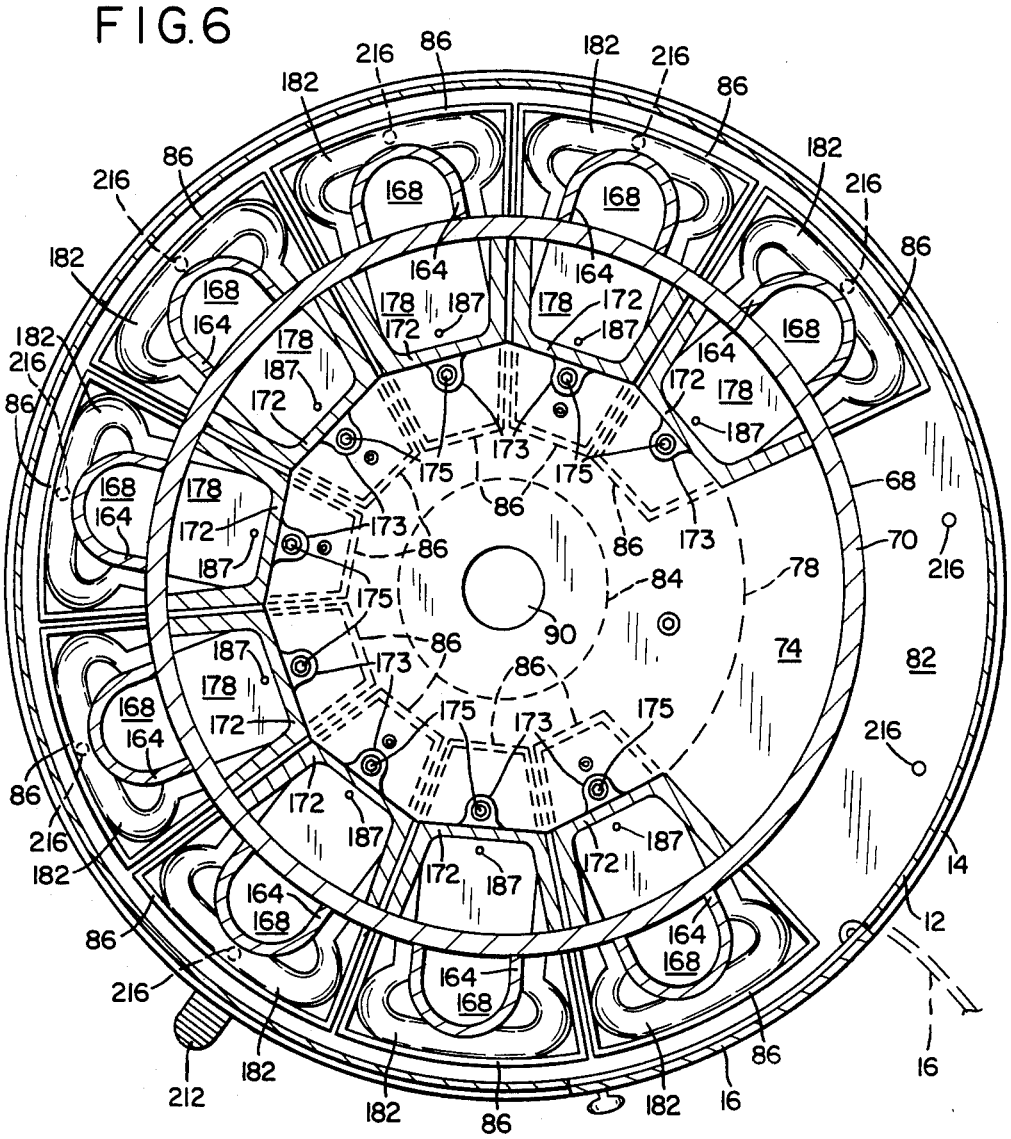
FIG. 6 is an enlarged, sectional view taken substantially along the line 6—6 of FIG. 3, showing the access door in phantom in the open position.

As shown in FIGS. 3 and 5, a hinge assembly 116 is rigidly attached to the interior of the frame sidewall 70 at a position above the disc 38 and pivotally attaches the hopper 34 to the sidewall. As previously described, the queueing head 38 is rigidly attached to the hopper 34 and is supported thereby above the upper surface of the disc 38. The vertical position of the head 36 above the upper surface of the disc 38 is adjustable through two adjustable spacer bolts 118 forming part of the hinge assembly 116 and a third adjustable spacer bolt (not shown) positioned to a side of the head generally opposite the hinge assembly. The third adjustable spacer bolt is releasably attached to the interior of the frame sidewall 70. Upon release of the third spacer bolt, the combined head 36 and hopper 34 assembly may be rotated upward about the hinge assembly 116 to lift the head away from the disc 38 for inspection, repair, cleaning and clearing of any obstruction which may occur.

The cylindrical frame sidewall 70 has a plurality of circumferentially positioned apertures 120 located according to the flight paths of the coins which are hurled from the disc 38 by the action of the coin-engaging wheels 60. The apertures 120 are sized to each supportably hold the coin-catching device 62 which receives the denomination of coin being sorted by the corresponding coin-engaging wheel 60. The flight paths of the coins after they leave the rotating disc 38 are shown by broken-line arrows in FIG. 5.

Figure 4:
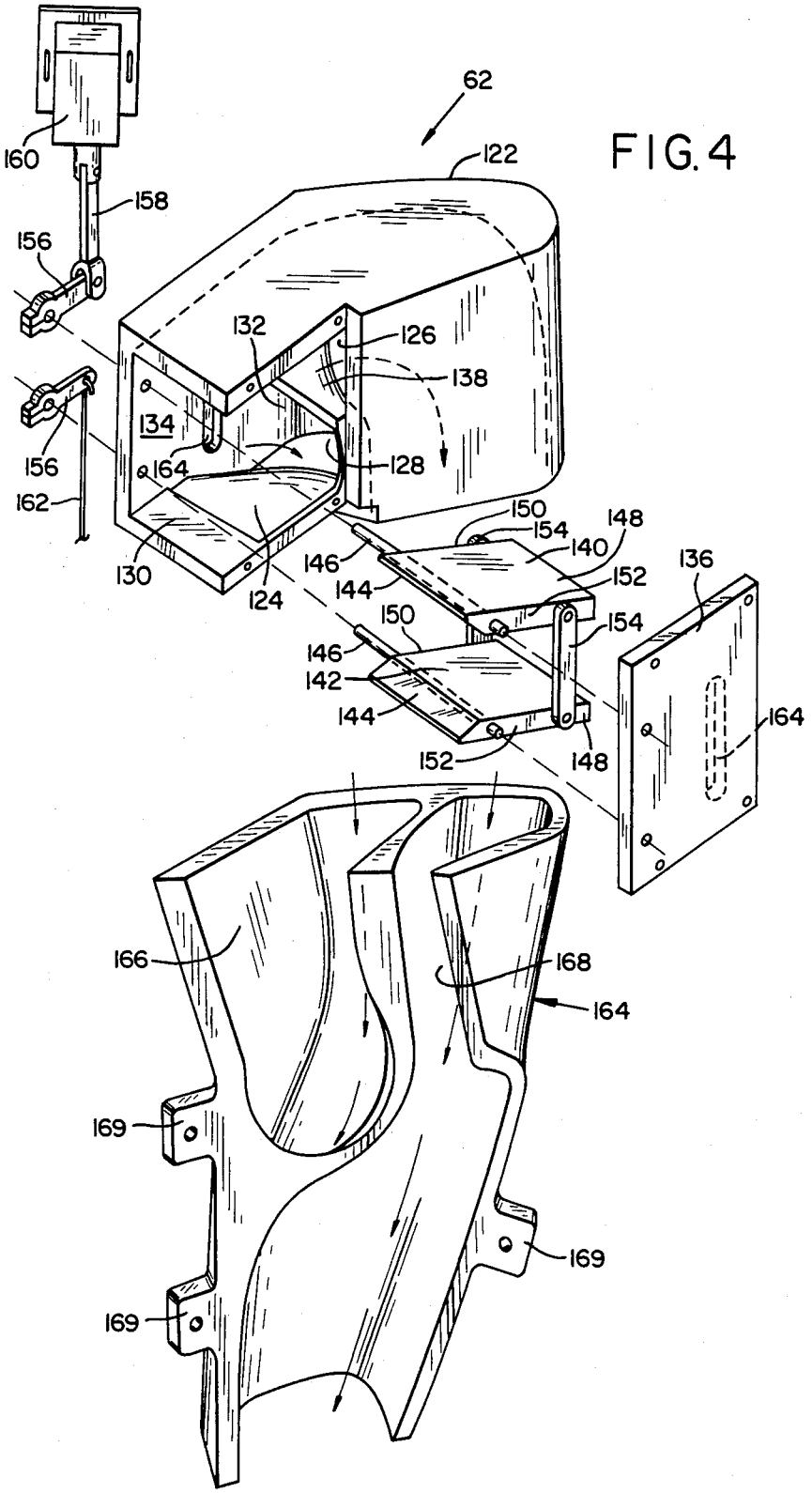
FIG. 4 is an enlarged, exploded view of the switching unit and coin guide of the present invention.

As shown in FIG. 4, the coin-catching device 62 has a coin-receiving body 122 with a mouth portion 124 and two channel portions 126 and 128. The mouth portion 124 has a first opening 130 position for receiving the stream of coins in flight therethrough, and a generally opposite second opening 132 communicating with an entry portion of each of the channels 126 and 128 for passage of the stream of coins from the mouth portion into the channels. The entry portion of each of the channels has a generally rectangular cross section.

The mouth portion 124 has opposing, vertically oriented interior walls 134 and 136 extending substantially between the first and second mouth openings 130 and 132. The one interior wall 136 comprises a plate removably attached to the remainder of the body 122. The entry portions of the channels 126 and 128 are positioned one above the other, in alignment with the interior walls 134 and 136 of the mouth portion 124. The channels 126 and 128 curved downwardly from their entry portions to exit portions from which the coins in the channels pass out of the body 122. The channels 126 and 128 are located adjacent to each other and are separated by a common interior divider wall 138 of the body 122.

A pair of spaced-apart upper and lower flaps or paddles 140 and 142, respectively, are disposed in the mouth portion 124 and extend substantially between the first and second mouth openings 130 and 132. The paddles 140 and 142 are oriented generally transverse to the interior walls 134 and 136, and are oriented for rotation in a vertical plane, with one positioned above the other. The paddles 140 and 142 each have a first end 144 pivotally mounted to the body 122 toward the first mouth opening 130 by a pivot pin 146 for rotation about a horizontal axis of rotation generally transverse to the mouth interior walls 134 and 136. The paddles 140 and 142 also have an opposite, free end 148 located toward the second mouth opening 132.

The paddles 140 and 142 each have longitudinal edge walls 150 and 152 extending between the first and second ends 144 and 148 of the paddles and positioned adjacent to the mouth interior walls 134 and 136, respectively, to prevent passage of coins therebetween. The paddles and the mouth interior walls define a laterally restricted coin conduit therebetween extending from the first to the second mouth openings 130 and 132. The paddles 140 and 142 are selectively pivotable about their first ends 144 to move the free second ends 148 between the channels 126 and 128 to connect the conduit to one or the other of the channels other of the channels and divert the stream of coins therein.

The paddles 140 and 142 are connected together for simultaneous movement by a pair of links 154 rotatably attached to the corresponding edge walls 150 and 152 of the paddles. The links 154 are attached to the paddles toward their free second end 148 and extend therebetween. The links 154 are positioned within interiorly facing recesses 164 in the mouth interior walls 134 and 136 to prevent interference of the links with the travel of the stream of coins through the body 122.

The pivot pin 146 for each paddle extends laterally outward beyond the coin-receiving body 122 and has an arm 156 tightly clamped thereto. A distal end of the arm 156 for the upper paddle 140 is connected to a tie rod 158 which is moved upward by an electrically actuated solenoid 160 for selectively pivoting the paddles 140 and 142 to connect the conduit with the upper entry portion of the channel 126. A distal end of the arm 156 for the lower paddle 142 is connected to a cable 162 which extends downward and is connected to another electrically activated solenoid (not shown) for selective pivoting of the paddles 140 and 142 to connect the conduit with the lower entry portion of the channel 128.

The paddles 140 and 142 extend beyond the first mouth opening 130 and have their first ends 144 inwardly beveled to deflect coins engaging the first ends inwardly between the paddles. The paddles 140 and 142 have an outwardly and downwardly slope when moved to connect the coin conduit with the upper entry portion of the channel 126, and have an inwardly and downwardly slope when moved to connect the coin conduit with the lower entry portion of the channel 128. In such fashion, any coins of the stream of coins landing on the lower paddle 142 will either slide outward, free of the coin-catching device 62, or inward into the lower entry portion of the channel 128, depending upon the position of the paddles. Thus, a buildup of coins on the lower paddle 142, which could clog the conduit and block entry of coins, is prevented.

The coin-catching device 62 channels coins received in flight at a position interior of the cylindrical frame sidewall 70 through the channels 126 and 128 for exit therefrom at a position exterior of the sidewall. As previously noted, the channels 126 and 128 divert the coins downward and have downwardly opening exit portions for the passage of the stream of coins therefrom. Positioned below the exit portions of the channels 126 and 128 for each coin-catching device 62 is a boot 164 for receiving the coins from the channels. The boot 164 has a pair of coin diversion channels 166 and 168, each having an open side portion positioned adjacent to the exterior of the frame sidewall 70. The boot 164 is removably attached to the sidewall 70 by a plurality of attachment ears 169 using removable fasteners (not shown), and the sidewall serves as a closure for the open side portion of the boot.

The one channel 168 of the boot 164 receives coins from the channel 126 of the coin-catching device 62 and diverts the coins generally downwardly into the coin-collecting receptacle 86 positioned directly therebelow on the carrier plate 82. The other channel 166 of the boot 164 receives coins from the channel 128 of the coin-catching device 62 and diverts the coins inwardly through one of a plurality of circumferentially positioned apertures 170 in the cylindrical frame sidewall 70. The sidewall apertures 170 are located below the support plate 46, and the open side of the channel 166 of each boot 164 is positioned over one of the apertures.

Positioned on the interior side of the frame sidewall 70 to receive and temporarily hold the coins passing through the sidewall apertures 170 are coin-holding tanks 172. One holding tank 172 is provided for each denomination of coin being sorted. The holding tank 172 has an open side portion positioned adjacent to the interior of the frame sidewall 70, over one of the sidewall apertures 170 for receiving coins passing therethrough (see FIG. 3). The sidewall 170 serves as a closure for the open side portion of the holding tank 172 and the tank is removably attached to the lower end wall 74 of the sidewall 70 by a lug 173 using a removable fastener 175. Each of the holding tanks 172 has a lower opening 174 positioned over an aperture 176 of similar size in a perimeter portion of the lower end wall 74. The lower opening 174 of the holding tank 172 and the aperture 176 in the lower end wall 74 are positioned to deposit coins passing therethrough into the coin-collecting receptacles 86 therebelow.

The opening 174 of the holding tank 172 is selectively closed by a manually operated slide gate 178 slidably mounted in a track 180 formed in the edge walls of the lower end wall 74 defining the aperture 176. The slide gate 178 has a handle 182 positioned radially outward of the frame sidewall 70 for grasping by an operator to selectively open and close the lower opening 174 of the holding tank 172 for releasing any coins collected therein. When the slide gate 178 is slid inward to close the holding tank 172, the handle 182 is positioned between the channel 168 of the boot 164 and the coin-collecting receptacle 86 in the flow of coins therebetween. To avoid disturbing the flow of coins, the handle 182 has an aperture 184 to pass the flow of coins therethrough. A spring detent 186 assists in positively maintaining the slide gate 178 in the closed position, and a stop pin 187 limits outward travel of the slide gate.

In operation, a batch of coins with an undifferentiated mix is sorted by denomination, and the coins of each denomination are hurled by centrifugal force upon their release from the disc 38 into the mouth portion 124 of the coin-catching device 62 for that particular denomination. The coin-catching device 62 diverts the stream of coins received downward through the channel 126 of the coin-catching device and into the channel 168 of the boot 164, which delivers the coins directly into the coin-collecting receptacle 86 for that particular denomination. When a preselected number of the sorted coins of that denomination are counted, the coin-catching device 62 pivotally moves the paddles 140 and 142 to divert the stream of the remainder of the sorted coins of that denomination in the batch being processed through the channel 128 of the coin-catching device and into the other channel 166 of the boot 164. The channel 166 of the boot 164 delivers the coins through the sidewall aperture 170 into the holding tank 172 for that denomination coin.

The holding tank 172 collects the sorted coins of that particular denomination in the batch in excess of the preselected number and temporarily holds them for later deposit in the coin-collecting receptacle 86 for that denomination coin. The excess sorted coins are held in the holding tank 172 until the entire batch of coins is sorted and counted, and the preselected number of coins which have been deposited in the coin-collecting receptacle 86 is removed therefrom. To transfer the coins in the holding tank 172 to the empty coin-collecting receptacle 86, the operator opens the slide gate 178 for the holding tank and releases the collected excess coins therein into the coin-collecting receptacle. After all coins have been released, the slide gate 178 is returned to the closed position and the apparatus is ready to sort and count the next batch of coins.

Since the coins in excess of the preselected number deposited in the coin-collecting receptacle 86 from the holding tank 172 by the apparatus have been counted, the number of coins transferred from the holding tank to the coin-collecting receptacle is known and when the next batch of coins is sorted, the apparatus starts the count with the number of coins that have been transferred.

In such manner, an entire batch of coins which may contain more coins of a particular denomination than the preselected number desired to be deposited in the coin-collecting receptacle for that denomination can be processed without stopping of the sorting and counting and without requiring the use of two coin-collecting receptacles, each sized large enough to receive the entire preselected number of coins. As such, a more compact coin-sorting and counting apparatus 10 requiring less floor space is possible. Furthermore, the necessity of stopping the sorting and counting process before a batch is fully sorted and counted is avoided, and the miscounts and jamming of the apparatus, which would occur as a result, are avoided.

In the presently preferred embodiment of the invention, the coin-collecting receptacles 86 have a generally wedge- or pie-shaped cross section with a truncated point, and are positioned on the carrier plate 82 concentrically about the outer post 76. The coin-collecting receptacles 86 have an open upper end and are sized to receive a standard coin bag 188 therein and to permit the folding outward of the open end portion of the bag over the mouth of the receptacle. The mouth of the coin-collecting receptacle 86 is sized so that the folded over portion of the bag 188 holds the bag tightly in position within the receptacle when coins are being deposited in the bag. The pie shape of the coin-collecting receptacles 86 provides a convenient pitcher shape for pouring of coins from the receptacle if it is desired to collect the coins in bulk or even if a coin bag 188 is used.

The coin-collecting receptacles 86 are each releasably and pivotally secured to the rotatable carrier plate 82 by a detachable hinge having a tongue 190 rigidly attached to the underside of the receptacle in a tunnel 192 formed therein (see FIGS. 3 and 9). The tongue 190 extends downwardly from the underside of the coin-collecting receptacle 86 and then radially inward to form an inward opening sized to rotatably receive a hinge pin 194 of a generally U-shaped member 196 rigidly attached to the carrier plate 82. The U-shaped member 196 not only serves as a component of the detachable hinge, but provides lateral guidance to the coin-collecting receptacle 86 as it is slid off and on the carrier plate 82. The tunnel 192 in the underside of the coin-collecting receptacle 86 has sufficient height to allow the member 196 to pass freely therethrough a restricted width to but a restricted width to limit the lateral movement of the receptacle. The tunnel 192 extends in a radial direction when the coin-collecting receptacle 86 is in position on the carrier plate 82.

The underside of the coin-collecting receptacle 86 has a beveled forward portion 198 which permits uninhibited tilting forward of the receptacle as it is pivoted about the detachable hinge and serves as a rest support against the carrier plate 82 when in the receptacle is tilted forward for removal of the coin bag 188. In the titled position the tongue 192 prevents removal of the coin-collecting receptacle 86 from the carrier plate 82.

The underside of the coin-collecting receptacles 86 also has a flat portion 200 extending rearwardly from the beveled portion 198 which provides a stable base when the receptacle is sitting on the carrier plate 82 or when it has been removed therefrom and is sitting on the floor for storage or other purposes. The coin-collecting receptacle 86 is provided with an upper handle slot 202 in the forward wall of the receptacle which may be grasped by the operator and pulled forwardly to cause the receptacle to pivot around the hinge pin 194 and tilt forward. A lower handle indentation 204 is provided in the beveled forward portion 198 of the underside of the coin-collecting receptacle 86. The handle indentation 204 may be grasped by the operator and pulled forwardly to disconnect the hinge tongue 190 from the hinge pin 194 when it is desired to remove the coin-collecting receptacle 86 from the apparatus 10. A magnetic latch 206 is provided to securely hold the coin-collecting receptacles 86 from unintentionally tilting forward, particularly when the carrier plate 82 is being rotated to gain access to one of the receptacles.

In operation, upon a preselected number of coins of a particular denomination having been deposited in a corresponding coin-collecting receptacle 86, the control panel 24 provides an audible and visual signal to the operator and indicates which receptacle has been filled with its preselected number of coins. The operator may open the door 16 and by grasping the handles 182 of the slide gates 178, rotate the inner frame 68 relative to the stationary base 14, and hence the coin-collecting receptacles 86 on the carrier plate 82, to position the indicated receptacle in the door opening without the operator being required to inconveniently move around the appartus 10 to reach the receptacle. An appropriate identifier may be placed on the handle 182 of the slide gate 178 or on an otherwise visible place so that the operator may easily determine which coin-collecting receptacle 86 is being rotated to the door opening.

The filled coin-collecting receptacle 86 may be tilted forward for convenient removal of the coin bag 188 and then replaced with an empty bag, or may be completely removed from the apparatus 10 and replaced with another receptacle holding an empty coin bag. The removal of the coins may be accomplished after a batch is completely processed or while the apparatus 10 is continuing to sort and count the coins of the batch, since any coins in excess of the preselected number for that particular denomination will be diverted into the holding tank 172 for that denomination and temporarily stored therein. It is noted that substantially all working components of the apparatus 10 interior of the case 12 are rotatable as a unit without interfering with the coin-sorting and counting operation of the apparatus.

After the apparatus 10 has completed the sorting and counting of the entire batch, the operator can open the slide gate 178 and dump the coins that have been stored in the holding tank 172 into the emptied coin-collecting receptacle 86. When all coin-collecting receptacles 86 which have reached the preselected number for that denomination of coin have been emptied, and the excess coins in the holding tanks 172 transferred into the receptacle, the next batch of coins held in one of the three loading trays 22 may be dumpted into the funnel 20. By loading each of the loading trays 22 with separate batches of coins to be sequentially processed, the overall operating speed of the apparatus 10 can be increased.

To minimize the possibility of too many coins being deposited in the holding tanks 172, the control panel 24 provides a first alarm when a coin-collecting receptacle 86 has received sufficient coins to bring it within a desired number of coins of the preselected number, and a second alarm to indicate that the receptacle has received sufficient coins to bring it within a smaller desired number of coins of the preselected number. In such manner, the operator is made aware that a coin-collecting receptacle 86, while not yet containing the preselected number of coins of a particular denomination, is so close to the preselected number that the next batch of coins to be processed might not only bring the receptacle up to the preselected number limit, but supply so many coins to the holding tank 172 that it will overflow. As such the operator can take appropriate steps to avoid the potential problem if the next batch of coins appears to have many coins of that particular denomination.

To provide for positive locking of the carrier plate 82 against unintended rotation when a coin-collecting receptacle 86 is being tilted forward or removed, and to provide for indexing means to insure the receptacle is properly positioned in the center of the door opening when doing so, a foot-actuated lock is provided. The lock includes an arm 208 pivotally attached by one end 210 to the stationary base 14 and projecting radially outward through the case 12 and terminating in a free end forming a foot pedal 212. The arm 208 carries a vertically projecting pin 214 and the carrier plate 82 has a plurality of corresponding pin-receiving locking holes 216. Each of the holes 216 is positioned for locking the carrier plate 82 against rotation with one of the coin-collecting receivers 86 centered at the door opening.

The arm 208 is biased to place the pin 214 in a locking hole 216 when the operator releases his foot from the foot pedal 212 by a spring 218 positioned between the arm and the stationary base 14. To prevent full 360° rotation of the inner frame 68 relative to the stationary base 14, and thereby avoid wrapping the electrical wires passing through the central opening 88 of the inner support post 80, a stop (not shown) is provided to engage the carrier plate 82 and limit rotation of the inner frame.

To help maintain the rigidity and cylindrical shape of the frame sidewall 70 and also to provide a mounting plate for the solenoids 160, an annular plate 220 receives the upper edge of the frame sidewall 70 in a correspondingly sized circumferential groove 222. The interior opening of the annular plate 220 is sized sufficiently large to permit free access to the head 36 and allow for its hinged opening.

As best shown in FIG. 3, an annular catching plate 224 is positioned below and fixedly attached to the underside of the rotating disc 38 for rotation therewith. The catching plate 224 extends radially outward from the disc 38 and has its perimeter edge wall positioned adjacent to the interior of the frame sidewall 70 with a minimal gap therebetween to prevent any coins from passing through the gap. The catching plate 224 is positioned to catch coins or foreign objects falling off or ejected from the disc 38 by the ejector wheel 66 and coins hurled form the disc by the coin-engaging sorting wheels 60 which have missed the target coin-catching device 62.

Any such coins or foreign objects landing on the catching plate 224 are moved by centrifugal force to the perimeter of the plate and against the interior of the frame sidewall 70. The sidewall 70 prevents the coins and foreign objects from leaving the catching plate 224 until they have been carrier around and reach an aperture 226 in the sidewall sized and positioned for any such caught coins or foreign objects to pass therethrough. A container 228 is mounted on the exterior of the sidewall over the aperture to receive and collect any such caught coins and foreign objects. A sensor 228 is positioned at the aperture 226 to detect passage of any such coins or foreign objects therethrough and provide an appropriate indicator signal to the operator. The container 228 is positioned for easy access by the operator upon removal of the top assembly lid 19.

In addition to having a compact design, the apparatus 10 of the present invention provides for convenient and cost-effective modular construction. The apparatus 10 may be assembled to produce a machine having the capability of sorting and counting any desired number of denominations up to the maximum capability of the apparatus by simply assembling the apparatus with the appropriate number of coin-engaging sorting wheels 60, sensor 64, coin-catching devices 62, boots 164, holding tank 172 and coin-collecting receptacles 86 for the number of denominations to be sorted and counted. In such manner, the apparatus 10 may be easily and economically custom assembled for particular customer's counting and sorting needs without modification to the manner of assembling the apparatus and without the installation of components which will not function for the particular configuration being assembled. A magnetic latch 206 is provided to securely hold the coin-collecting receptacle 86 from unintentionally tilting forward, particularly when the carrier plate 82 is being rotated to gain access to one of the receptacles. In addition to the ability to easily custom assemble the apparatus 10, an existing apparatus can subsequently be easily upgraded to accommodate more denominations of coin.

It will be appreciated that, although a specific embodiment of the invention has been described herein for purposes of illustration, various modifications may be made without departing from the spirit and scope of the invention. Accordingly, the invention is not limited except as by the appended claims.

We claim:

1. A coin-sorting and counting apparatus, comprising:

a rotatable disc for receiving on a central portion thereof a batch of coins to be sorted and counted by denominations;

queueing means for guiding said batch of coins into a queue and delivering said queued coins to a perimeter portion of said disc;

sorting means for continuously sorting said coins at said perimeter portion until said batch is entirely sorted, said sorting means selectively releasing said sorted coins from said disc at selected locations along the circumference of said disc according to coin denomination, said sorted coins being hurled by centrifugal force upon release from said disc;

counting means for counting said sorted coins according to denomination;

first coin-collecting means for collecting preselected numbers of said sorted coins of said batch according to denomination, and for selectively removing said collected coins from the apparatus;

second coin-collecting means for collecting and releasably holding said sorted coins of said batch in excess of said preselected numbers according to denomination; gate means for selectively controlling each of said second coin-collecting means to substantially simultaneously dump all of said collected excess coins of said batch in said second coin-collecting means into said first coin-collecting means according to denomination after removal from the apparatus of said preselected numbers of coins collected by said first coin-collecting means; and coin receiver means for receiving said sorted coins hurled by said disc according to denomination, and for selectively diverting said hurled sorted coins to said first or second coin-collecting means, said coin receiver means first diverting said hurled sorted coins to said first coin-collecting means according to denomination, and in response to said preselected numbers of coins being counted by said counting means, diverting said hurled, sorted coins in excess of said preselected number to said second coin-collecting means.

2. The coin-sorting and counting apparatus of claim 1 wherein said first coin-collecting means include a single coin receptacle for each denomination of coin being sorted and said second coin-collecting means includes a holding tank for each denomination of coin being sorted, each of said holding tanks having a coin receiving port positioned to receive and collect said excess sorted tanks from said coin receiver means and a coin discharge port positioned above a corresponding denomination coin receptacle to allow substantially unihibited and rapid substantially simultaneous discharge of said collected excess sorted coins from said holding tank to said corresponding denomination coin receptacle under the force of gravity, each of said coin discharge ports having a selectively operable closure for selective discharge of said excess sorted coins collected within said holding tank directly into said coin receptacle for the corresponding denomination of coin, whereby said batch of coins can be entirely sorted and counted without stopping while using a single coin receptacle for each denomination coin even though said batch contains more coins of a particular denomination than said preselected number of coins for the denomination.

3. The coin-sorting and counting apparatus of claim 1, further including a catching plate fixedly attached to said disc for rotation therewith, said plate being positioned below said disc and extending outward beyond said disc to catch coins and foreign objects falling off or ejected from said disc and said hurled sorted coins missing said coin receiver means, said caught coins and foreign objects being moved by centrifugal force to a perimeter portion of said plate, and the apparatus further including a wall extending about said perimeter portion of said plate for retaining said caught coins and foreign objects on said plate, and receiving means for receiving and collecting said caught coins and foreign objects from said plate, said wall having an aperture through which said caught coins and foreign objects can pass under the influence of the centrifugal force to escape said plate, and said receiving means being positioned at said aperture outward of said wall to receive said caught coins and foreign objects passing through said aperture.

4. The coin-sorting and counting apparatus of claim 3, further including detecting means for detecting the presence of said caught coins and foreign objects.

5. The coin-sorting and counting apparatus of claim 1, further including a plurality of selectively operable coin dump trays positioned to dump coins held therein onto a central portion of said disc, each of said dump trays being sized to hold one batch of coins to be sorted and counted, whereby several batches of coins can be staged for sequential processing to increase speed of operation.

6. A coin-sorting and counting apparatus, comprising:

a stationary base;

a generally cylindrical frame wall rotatably mounted on said base for selective rotation relative thereto about a generally vertically oriented longitudinal axis, said frame wall having a plurality of circumferentially positioned apertures;

a rotatable disc for receiving thereon a batch of coins to be sorted and counted by denomination, said disc being positioned radially inward of said frame wall;

queueing means for guiding said batch of coins into a queue and delivering said queued coins to a perimeter portion of said disc;

sorting means for sorting said coins at said perimeter portion, said sorting means selectively releasing said sorted coins from said disc at selected locations along the circumference of said disc according to coin denomination, said sorted coins being hurled by centrifugal force upon release from said disc;

counting means for counting said sorted coins according to denomination;

a plurality of first coin-collecting receptacles for collecting preselected numbers of said sorted coins according to denomination, and for selectively removing said collected coins from the apparatus, said first coin-collecting receptacles being mounted for rotation with said frame wall;

a plurality of second coin-collecting receptacles for collecting said sorted coins of said batch in excess of said preselected numbers according to denomination, said second coin-collecting receptacles being positioned radially inward of said frame wall to receive said excess sorted coins passing inwardly from exterior of said frame wall through said frame wall apertures and being positioned to transfer said collected excess sorted coins to said first collecting receptacles according to denomination, said second coin-collecting receptacles being mounted for rotation with said frame wall;

a plurality of closure members for said second coin-collecting receptacles, said closure members being selectively and individually operable for selective transfer of said collected excess sorted coins from said second coin-collecting receptacles to said first coin-collecting receptacle according to denomination; and a plurality of coin receivers mounted for rotation with said frame wall and positioned circumferentially thereabout to receive said sorted coins hurled by said disc according to denomination and channel said hurled sorted coins outward of said frame wall, said coin receivers selectively diverting said hurled sorted coins to said first coin-collecting receptacles or in response to said predetermined numbers of coins being counted by said counting means, through said frame wall apertures to said second coin-collecting receptacles according to denomination, whereby when a first coin receptacle for a particular denomination of coin has the preselected number of coins deposited therein, the excess sorted coins of that denomination in the batch are deposited in the second coin receptacle for that denomination, and whereby the frame wall can be selectively rotated to conveniently position the first coin receptacle for removal of the collected coins therefrom and then the excess sorted coins collected in the second coin receptacle can be selectively transferred to the emptied first coin receptacle by operation of the closure member for the second coin receptacle.

7. The coin-sorting and counting apparatus of claim 6 wherein said second coin-collecting receptacles include a holding tank for each denomination of coin being sorted, each of said holding tanks having a coin receiving port positioned to receive said excess sorted coins from said coin receiver for the corresponding denomination of coin and a coin discharge port with a selectively operable closure for selective discharge of said excess sorted coins collected within said holding tank directly into said first coin-collecting receptacle for the corresponding denomination of coin.

8. The coin-sorting and counting apparatus of claim 6, further including a catching plate fixedly attached to said disc for rotation therewith, said plate being positioned below said disc and extending radially outward beyond said disc to catch coins and foreign objects leaving said disc and missing said coin receiver means, said caught coins and foreign objects being moved by centrifugal force to a perimeter portion of said plate positioned adjacent to said frame wall, said frame wall retaining said caught coins and foreign objects on said plate until reaching an aperture in said frame wall sized for passage of said caught coins and foreign objects under the influence of the centrifugal force, the apparatus further including a container positioned at said aperture outward of said frame wall and sized to receive said caught coins and foreign objects.

9. The coin-sorting and counting apparatus of claim 8, further including detecting means for detecting the presence of said caught coins and foreign objects.

10. The coin-sorting and counting apparatus of claim 6, further including a plurality of selectively operable coin dump trays positioned to sequentially dump coins held therein onto a central portion of said disc, each of said dump trays being sized to hold one batch of coins to be sorted and counted.

11. The coin-sorting and counting apparatus of claim 6 wherein said first coin-collecting receptacles are open-ended containers and are carried on a carrier plate mounted for rotation with said frame wall, each of said containers for a particular denomination of coin being positioned below one of said coin receivers and one of said second coin-collecting receptacles for the corresponding denomination of coin to receive coins therefrom, whereby coins can be deposited into said containers by gravity feed.

12. The coin-sorting and counting apparatus of claim 11 wherein said containers are sized to removably hold a coin bag therein and pivotally attached to said carrier plate for selective outward tilting of said containers, whereby the coin bag can be easily removed from the containers.

13. The coin-sorting and counting apparatus of claim 12 wherein said containers are releasably secured to said carrier plate, whereby the container can be selectively tilted or easily removed for storage of the coins therein away from the apparatus and easy replacement with another container.

14. The coin-sorting and counting apparatus of claim 13 wherein said containers are releasably secured to said carrier plate by a detachable hinge.

15. The coin-sorting and counting apparatus of claim 13 wherein said containers have a beveled portion for supportably engaging said carrier plate when tilted, and a flat portion for supportably engaging said carrier plate when resting upright thereon, said flat portion being sized to self-support said container in an upright attitude when removed from the apparatus and resting on a level surface.

16. The coin-sorting and counting apparatus of claim 11 wherein said containers are releasably secured to said carrier plate.

17. The coin-sorting and counting apparatus of claim 11 wherein said containers have a generally wedge-shaped cross section and are positioned below and generally concentric with said frame wall.

18. The coin-sorting and counting apparatus of claim 11 wherein said containers are releasably secured to said carrier plate by detachable hinges, each of said hinges including a portion fixedly attached to said carrier plate and said containers having a downwardly opening, elongated guide channel portion sized and positioned to slidably receive said hinge portion therein for limiting lateral movement of said containers as said containers are moved on said carrier plate with said hinge detached, said channel portions extending in a radial direction when said containers are in position on said carrier plate.

19. The coin-sorting and counting apparatus of claim 6 wherein said second coin-collecting receptacles are holding tanks, each of said tanks having an open side positioned adjacent to the interior of said frame wall over one of said frame wall apertures for receiving coin passing therethrough, and having an open lower side selectively closed by one of said closure members.

20. The coin-sorting and counting apparatus of claim 19 wherein said closure members are manually operable slide gates, said gates each having a bundle for operatively grasping by the operator, and being outwardly slidable to open said lower side of one of said holding tanks for the transfer of said collected excess sorted coins therein, said handle being positioned between one of said coin receivers and one of said first coin-collecting receptacles in the flow of coins of a particular denomination therebetween, and having a handle aperture to pass the flow of coins when said handle is in a position to close said lower side of said holding tank.

21. The coin-sorting and counting apparatus of claim 20, further including a mounting plate having a plurality of perimeter apertures along a perimeter portion thereof, said mounting plate being attached to said frame wall for rotation therewith, and wherein said open lower side of said holding tanks are positioned adjacent to said mounting plate, each over one of said perimeter apertures.

22. The coin-sorting and counting apparatus of claim 21 wherein said slide gates are slidably supported by said mounting plate.

23. The coin-sorting and counting apparatus of claim 19 wherein said holding tanks are individual components separately attachable to the apparatus, whereby the apparatus can be selectively assembled with a number of holding tanks corresponding to the number of denominations of coins to be sorted and counted.

24. The coin-sorting and counting apparatus of claim 6, further including a plurality of channel members attached to the exterior of said frame wall for receiving said sorted coins from said coin receivers, said channel members each having first and second coin diversion channels for diverting coins of a particular denomination of coins, said first channel diverting coins into one of said first coin-collecting receptacles and said second channel diverting coins inwardly through said frame wall apertures into one of said second coin-collecting receptacles.

25. The coin-sorting and counting apparatus of claim 24 wherein said channel members each have an open side positioned adjacent to the exterior of said frame wall, with said second channel positioned over one of said frame wall apertures for diversion of coins therethrough.

26. The coin-sorting and counting apparatus of claim 6, further including lock means for selectively locking said frame wall against rotation.

27. The coin-sorting and counting apparatus of claim 26 wherein said lock means includes a foot pedal actuated releasable lock, said lock being biased to a locked position and being released to unlock said frame wall when said foot pedal is operatively moved.

28. The coin-sorting and counting apparatus of claim 6, further including a circular catching plate fixedly attached to said disc for rotation therewith, said plate being positioned below said disc and extending outward beyond said disc toward said frame wall to catch coins and foreign objects falling off or ejected from said disc and said hurled sorted coins missing said coin receiver means, said caught coins and foreign objects being moved by centrifugal forces to a perimeter portion of said plate and being retained thereon by said frame wall, said plate having a circumferential edge wall positioned adjacent to the interior of said frame wall to inhibit passage of said caught coins and foreign objects therebetween, said frame wall having an opening through which said caught coins and foreign objects can pass under the influence of the centrifugal force to escape said plate, and the apparatus further including a container positioned at said opening outward of said frame wall to receive said caught coins and foreign objects passing through said opening, whereby said container can be positioned for easy access by an operator of the apparatus.

29. The coin-sorting and counting apparatus of claim 28, further including detecting means for detecting passage of said caught coins and foreign objects through said opening.

30. The coin-sorting and counting apparatus of claim 6, further including a generally cylindrical outer case, said case having a portal for removal therethrough of coins from said first coin-collecting receptacles, said frame wall being rotatable to selectively position one of said first coin-collecting receptacles at said portal.

31. The coin-sorting and counting apparatus of claim 30, further including a door hingedly attached to said outer case for selectively closing said portal.

32. The coin-sorting and counting apparatus of claim 6 wherein said frame wall has a plurality of circumferentially positioned second apertures positioned above said first frame wall apertures, said second apertures having said coin receivers extending therethrough to receive said hurled sorted coins inward of said frame wall and channel said hurled sorted coins through said second apertures to the exterior of said frame wall.

33. A method of processing a batch of coins, comprising:

continuously sorting a batch of coins by denomination until said batch is entirely sorted;

counting and depositing preselected numbers of said sorted coins of said batch according to denomination in a plurality of first coin-collecting receptacles, one for each denomination being sorted;

providing a signal to an operator indicating particular ones of said coin-collecting receptacles have received said preselected numbers of said sorted coins;

removing said collected coins from said first coin-collecting receptacles;

counting and depositing said sorted coins of said batch in excess of said predetermined numbers according to denomination in a plurality of temporary second coin-collecting receptacles, one for each denomination being sorted;

selectively controlling each of said second collecting receptacles to substantially simultaneously transferring all of said collected excess sorted coins of said entirely sorted batch in said second collecting receptacles to said first collecting receptacles according to denomination after said preselected numbers of collected coins have been removed from said first coin-collecting receptacles, whereby one of several successive batches of coins containing coins of particular denominations in excess of the preselected numbers desired to be deposited in the first coin-collecting receptacles can be continuously processed to completion without termination of the sorting and counting when the preselected number of coins is reached in order to empty the coin-collecting receptacle.

34. A coin-sorting and counting apparatus, comprising:

means for continuously and completely sorting and counting a batch of coins by denomination;

first coin-collecting means for collecting preselected numbers of said sorted coins of said batch according to denomination, and for selectively removing said collected coins from the apparatus;

second coin-collecting means for collecting and releasably holding said sorted coins of said batch in excess of said preselected numbers according to denomination;

means for selectively controlling each of said second coin-collecting means to substantially simultaneously transfer said collected excess coins of said batch from said second coin-collecting means into said first collecting means according to denomination after removal from the apparatus of said preselected numbers of coins collected by said first coin storage means; and coin receiver means for receiving said sorted and counted coins according to denomination, and for selectively diverting said coins to said first or second coin-collecting means according to denomination, said coin receiver means first diverting said coins to said first collecting means and in response to said preselected numbers of coins being counted by said sorting and counting means, diverting said coins in excess of said preselected numbers to said second coin-collecting means.

35. The coin-sorting and counting apparatus of claim 34 wherein said second coin-collecting means includes a holding tank for each denomination of coin being sorted, each of said holding tanks having a coin receiving port positioned to receive and collect said excess sorted coins from said coin receiver means for the corresponding denomination of coin and a coin discharge port with a selectively operable closure gate for selective and substantially simultaneously discharge of said excess sorted coins collectively within said holding tank directly into said first coin-collecting means for the corresponding denomination of coin.

36. The coin-sorting and counting apparatus of claim 35 wherein said closures are manually operable slide gates, said gates each having a handle for operatively grasping by the operator, and being outwardly slidable to open said coin discharge port of one of said holding tanks for the transfer of said collected excess sorted coins therein, said handle being positioned between one of said coin receiving means and one of said first coin-collecting means in the flow of coins of a particular denomination therebetween, and having a handle aperture to pass the flow of coins when said handle is in a position to close said discharge port.

37. The coin-sorting and counting apparatus of claim 36 wherein said closures are slide gates.

38. A coin-sorting and counting apparatus, comprising:

a stationary base;

a frame rotatably mounted on said base for selective rotation relative thereto;

means for sorting and counting a batch of coins by denomination;

a plurality of first coin-collecting receptacles for collecting preselected numbers of said sorted coins according to denomination, and for selectively removing said collected coins from the apparatus, said first coin-collecting receptacles being mounted for rotation with said frame;

a plurality of second coin-collecting receptacles for collecting said sorted coins of said batch in excess of said preselected numbers according to denomination, said second coin-collecting receptacles being positioned to transfer said collected excess sorted coins to said first collecting receptacles according to denomination and being mounted for rotation with said frame;

a plurality of closure members for said second coin-collecting receptacles, said closure members being selectively and individually operable for selective transfer of said collected excess sorted coins from said second coin-collecting receptacles to said first coin-collecting receptacle according to denomination; and a plurality of coin receivers mounted for rotation with said frame and positioned to receive said sorted coins according to denomination and to selectively channel said sorted coins to said first coin-collecting receptacles and in response to said predetermined number of coins being counted to said second coin-collecting receptacles according to denomination.

39. The coin-sorting and counting apparatus of claim 38 wherein said first coin-collecting receptacles are open-ended containers and are carried on a carrier plate mounted for rotation with said frame, each of said containers for a particular denomination of coin being positioned below one of said coin receivers and one of said second coin-collecting receptacles for the corresponding denomination of coin to receive coins therefrom.

40. The coin-sorting and counting apparatus of claim 39 wherein said containers are pivotally attached to said carrier plate for selective outward tilting of said containers.

41. The coin-sorting and counting apparatus of claim 40 wherein said containers are releasably secured to said carrier plate by detachable hinges.

42. The coin-sorting and counting apparatus of claim 41 wherein said containers have a beveled portion for supportably engaging said carrier plate when tilted, and a flat portion for supportably engaging said carrier plate when resting upright thereon, said flat portion being sized to self-support said container in an upright attitude when removed from the apparatus and resting on a level surface.

43. The coin-sorting and counting apparatus of claim 41 wherein each of said hinges includes a portion fixedly attached to said carrier plate and said containers have an elongated guide channel portion sized and positioned to slidably receive said hinge portion therein for limiting lateral movement of said containers as said containers are moved on said carrier plate with said hinge detached, said channel portions extending in a radial direction when said containers are in position on said carrier plate.

44. The coin-sorting and counting apparatus of claim 39 wherein said containers are positioned below said frame for generally concentric rotation therewith.

45. The coin-sorting and counting apparatus of claim 38, further including lock means for selectively locking said frame against rotation.

* * * * *